US006116424A

United States Patent [19]

Leu

[11] Patent Number: 6,116,424

[45] Date of Patent: Sep. 12, 2000

[54] BAG DISPENSER

[76] Inventor: Corell M. T. Leu, 9868 James River Cir., Fountain Valley, Calif. 92708

[21] Appl. No.: 09/391,441

[22] Filed: Sep. 8, 1999

[51] Int. Cl.[7] ..... B65D 33/14

[52] U.S. Cl. ..... 206/554; 206/806

[58] Field of Search ..... 206/554, 806; 383/22, 79, 92

[56] References Cited

U.S. PATENT DOCUMENTS

| | | | |
|---|---|---|---|
| 5,524,762 | 6/1996 | Shafran et al. | 206/554 |
| 5,772,035 | 6/1998 | Harrison | 206/554 |
| 5,788,080 | 8/1998 | Sill et al. | 206/554 |

*Primary Examiner*—Jacob K. Ackun
*Attorney, Agent, or Firm*—William Patrick Waters

[57] ABSTRACT

A polymer bag dispenser, having a header for receiving a plurality of stacked bags, the header having a leading edge. A plurality of bags is stacked and retained within the header. Each one of the bags has a back panel and a front panel wherein the back panel is longer than the front panel. Each bag includes a lip connected to the bag back panel. A line of perforations is formed in the back panel and the line of perforation is substantially adjacent to, and parallel with, the header leading edge. The line of perforations is created after a stack of bags has been formed in the header. In order to ensure clean separation of a bag from the header and a sharp and uniform edge for lips retained within the header, the line of perforations is disposed at a distance of about ¼ inch away from the header leading edge. Each one of the panel lips is retained by the header when a bag is separated therefrom, along the line of perforations. As an aid in providing a front free configuration, the header has a curved, centrally located cutout therein formed. The cutout affords easy user access to the topmost bag in the stack and facilitates separation of a bag therefrom.

20 Claims, 3 Drawing Sheets

BAG DISPENSER

BACKGROUND OF THE INVENTION

The present invention relates generally to bag dispensers and, more particularly, to stacked polymer bag dispensers.

At the present time, many retail establishments have eliminated, or substantially reduced, use of conventional paper bags and have replaced these bags with polymer bags. One of the reasons for such replacement is economic since the polymer bags are less expensive to manufacture. In addition, the polymer bag is impervious to liquids and thus has utility in places, such as the produce area of markets, where they are preferred over conventional paper bags that tear when wet.

In some applications, polymer bags are difficult to use. Food markets, for example, utilize rolls containing a substantial number of bags that are attached one to the other in a top to bottom relationship. In use, the topmost bag is separated from the next in order when it is torn therefrom along a line of perforations. The removed bag sometimes presents a challenge to a customer attempting to insert produce into it. Since the top and bottom of the bag are similar it is sometimes difficult to find the bag opening. While this limitation may be only a minor irritant to a shopper in a market, it becomes a serious limitation in cases where it is necessary to insert many newspapers or flyers, one by one, into polymer bags.

Some of the limitations of dispensing polymer bags from a roll are eliminated when the bags are dispensed from a stack. In such cases, it is relatively easy for a user to discern the top of the bag from the bottom and in a typical setting, conventional stacked bags are useful.

However, in cases where it is desirable to insert materials repetitively and rapidly, as in the example of newspapers or flyers, some conventional stacked bags slow up the process because of inherent design limitations, as the user finds it difficult to remove cleanly one bag at a time from the stack.

In conventional stacked bag arrangements, each bag contains a line of perforations that permit a user to tear a bag, from a stack of fifty to a hundred bags, one bag at a time. Conventionally, the line of perforations is generated during the bag conversion process when the plastic film is run under a serrated wheel attached to the bagging machines. The line of perforations separate a bag, which can be torn from the stack, and a lip which remains in the stack. While the lines of perforations produced by the serrated wheel are almost always straight, the position of the lines sometimes shifts slightly from one bag to another.

As a result, when the bags are arranged in a stack, misalignment of lines of perforations, in one bag relative to another, can cause problems for a user attempting to remove a bag from the stack. This limitation is best seen in cases where the user tries to insert material, such as newspapers and flyers, in a short period of time.

A substantial factor causing this problem in conventional stacked bag systems is the aforementioned misalignment of the lines of perforations. As bags are removed, they are separated from their respective lips, which are left behind. The edges of the residual lips are frequently misaligned, because of the failure of lines of perforations to line up uniformly. As a result of lip misalignment, it becomes progressively more difficult to remove a bag from a stack. This limitation can be substantial in some cases, such as newspaper and flyer insertions, where speed and ease of insertion and bag removal from a stack are important considerations.

In view of the foregoing it will be apparent that there is a need for an efficient and effective technique for stacking polymer bags such that individual bags can be readily and conveniently removed. Desirably, such a technique would permit front free disposition of a bag, while it is still part of the stack, to enhance the efficiency and speed of material insertion.

DISCLOSURE OF THE INVENTION

According to the present invention there is provided a technique that enables front free access to a stacked bag and convenient removal of the bag from the stack.

In a preferred embodiment, the invention provides a polymer bag dispenser, having a header for receiving a plurality of stacked bags, the header having a leading edge. A plurality of bags is stacked and retained within the header. Each one of the bags has a back panel and a front panel wherein the back panel is longer than the front panel. Each bag includes a lip connected to the bag back panel. A line of perforations is formed in the back panel and the line of perforation is substantially adjacent to, and parallel with, the header leading edge. The line of perforations is created after a stack of bags has been formed in the header. In order to ensure clean separation of a bag from the header and a sharp and uniform edge for lips retained within the header, the line of perforations is disposed at a distance of about ¼ inch away from the header leading edge. Each one of the panel lips is retained by the header when a bag is separated therefrom, along the line of perforations. As an aid in providing a front free configuration, the header has a curved, centrally located cutout therein formed. The cutout affords easy user access to the topmost bag in the stack and facilitates separation of a bag therefrom.

The present invention affords several advantages. In the first place, the location of the line of perforations, separate from the header, permits easy access to the topmost bag in a stack. In addition, since only the back panel includes a line of perforations, the shorter front panel can be separated easily from the back panel, and from the header, to present a front free configuration. This represents a significant improvement over conventional stacked bag systems because it enables a user to insert a newspaper or a flyer into a bag, before the bag is separated from the stack. Thus, a more efficient and time saving bag packing technique is provided.

Further, the location of the line of perforations, separated from the header leading edge, enables an uniform edge to be formed by the residual lips. In this manner, the lips not only do not interfere with bag removal, but as bags are removed from the stack, the edge of the residual lips increases in thickness to present a surface that facilitates still further the bag separation process.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 3:
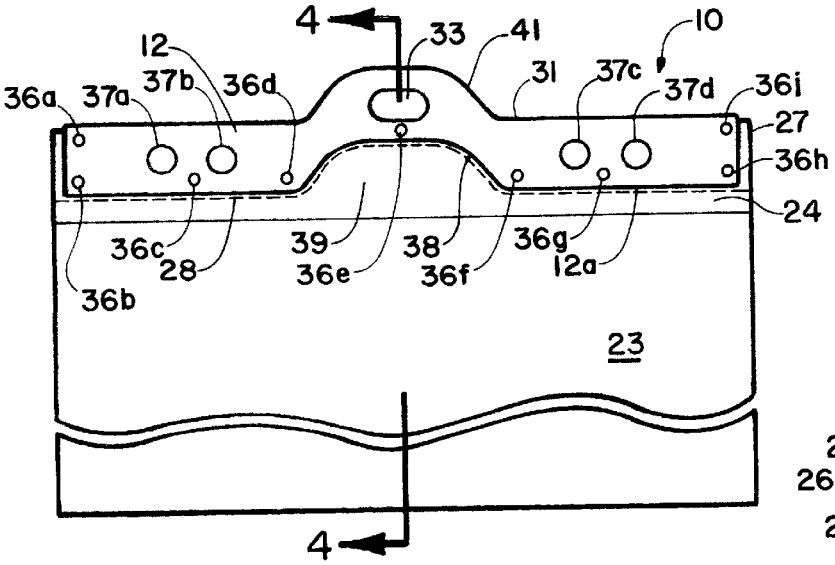
FIG. 3 is a front elevational view of a polymer bag dispenser that is constructed according to the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

In the following detailed description and in the several figures of the drawings, like elements are identified with like reference numerals.

Figure 1:
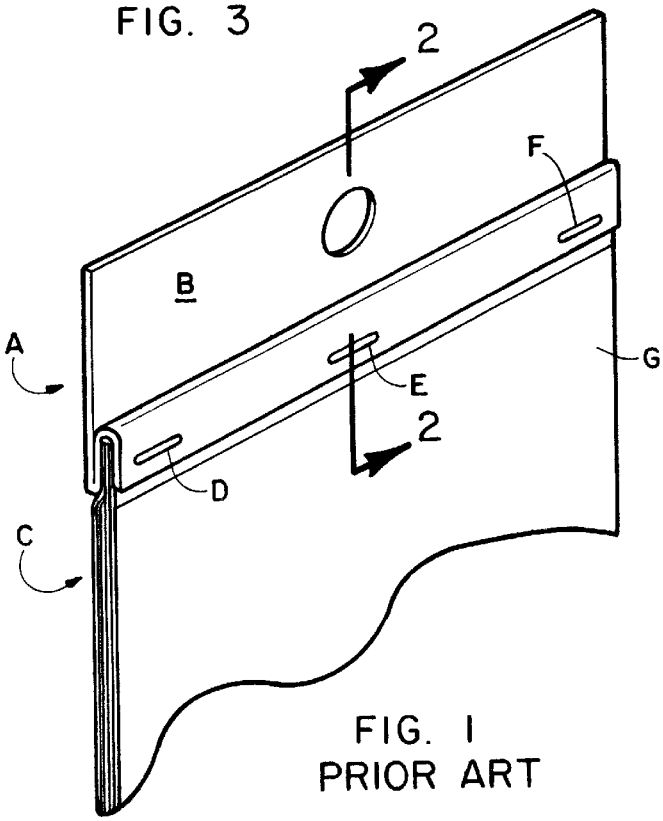
FIG. 1 PRIOR ART
FIG. 1 is a perspective view of a prior art polymer bag dispenser.
Figure 2:
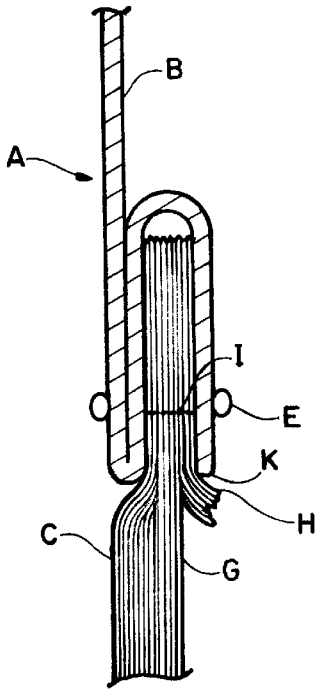
FIG. 2 PRIOR ART
FIG. 2 is a sectional view, taken along the line 2—2 of the prior art polymer bag dispenser shown in FIG. 1.

Before discussing the novelty and advantages of the polymer bag dispenser of the present invention, it will be helpful to review some aspects of a conventional bag dispenser, as shown in FIGS. 1 and 2. A polymer bag dispenser A includes a stack of bags C retained within a header B. The bags are held within the header B by staples D, E and F. In at least some cases, the bags have had a line of perforations I formed in the bags, before they are stacked for retention within the header B. As mentioned above, this method of assembly can produce an uneven accumulation of residual lips, such as the lips H, when a number of bags have been removed from the stack.

As a topmost bag, such as the bag G, is removed, the residual lips H are pushed upwardly, against a leading edge K of the header B, thereby making bag removal difficult. Of course, as more bags are removed from the header B, the stack of residual lips H increases in size and becomes increasingly unwieldy. As a result, bag removal becomes increasingly more difficult.

Another limitation of the prior art bag dispenser is illustrated in FIG. 2 wherein a line of perforations I for separation of a bag from the stack C is located well within the header B. This location of the line of perforations requires the user to pull the bag downwardly from the header B whereas the line of perforations functions most efficiently when a bag is torn transversely across it.

Still another limitation of the prior art dispenser is that the presence of the uneven accumulation of lips H can prevent easy access to the bag opening while the bag is still in the stack. As a result, use of the conventional dispenser for front loading operations, such as insertion of newspapers or flyers, while the bag is still in the stack, is precluded. In view of the above, it is evident that several limitations impair the value and utility of prior art bag dispensers.

Figure 4:
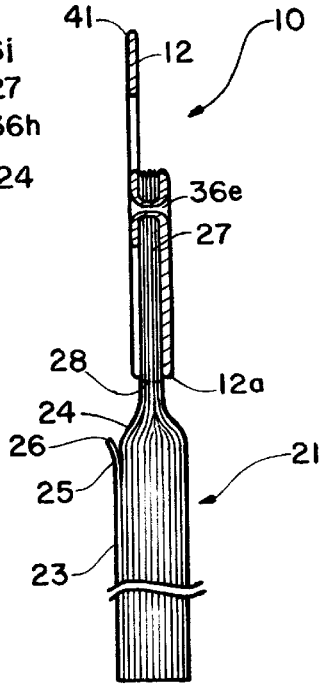
FIG. 4 is a sectional view, taken along the line 4—4, of the polymer bag dispenser shown in FIG. 3.
Figure 5:
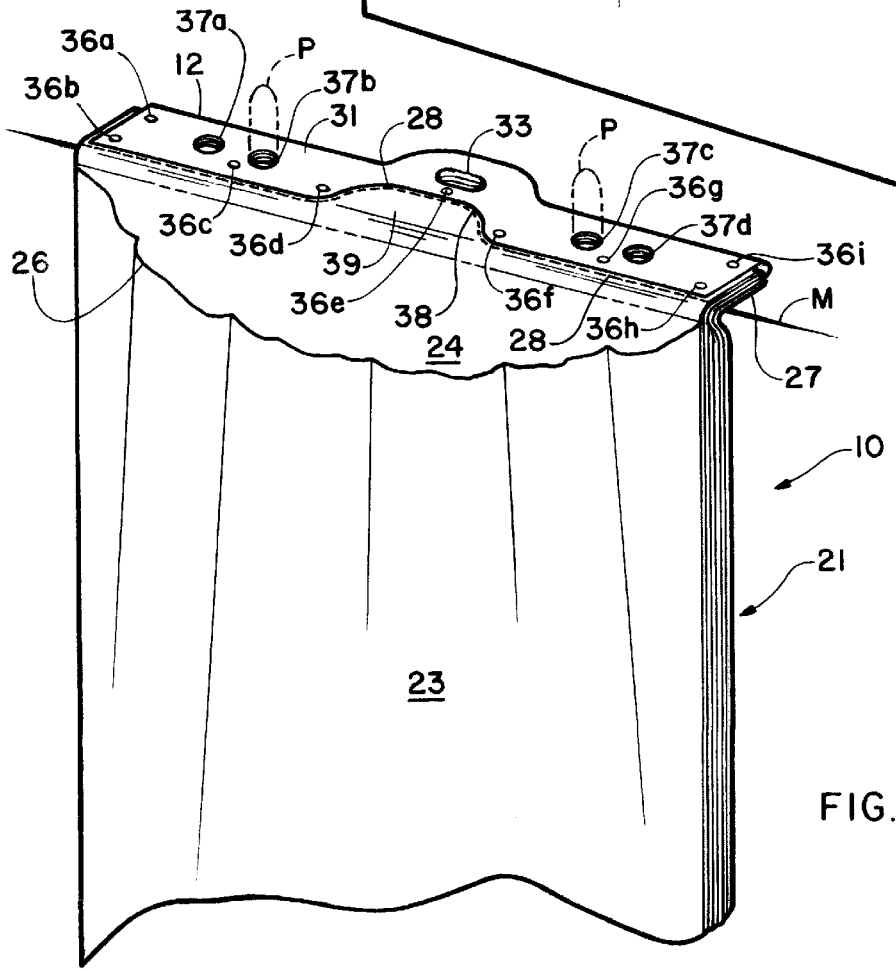
FIG. 5 is a perspective view of the polymer bag dispenser shown in FIG. 3 and depicting one method of locating the dispenser for use.

On the other hand, and as shown in FIGS. 3–5 for purposes of illustration, the present invention is embodied in a novel polymer bag dispenser 10 that, in typical cases, comes fully loaded with 50 or 100 fungible polymer bags, arrayed in an ordered stack 21. The stack 21 is retained within a header 12 and the bags are fused by heat at points 36*a*–36*i*.

Each individual bag, of which a top most bag 23 is exemplary, is rectangular having a front panel 25, and a back panel 24. The panels 24 and 25 are secured along their side and bottom edges. The top edges of the front panel 25 and of the back panel 24 are left separate from each other and together they define an opening 26 into the interior of the bag 23. The back panel 24 is longer than the front panel 25 and, at a location above the top edge of the front panel 25, a line of perforations 28 is formed across the back panel 24. The line of perforations 28 provides a line of demarcation between the back panel 24 and a integrally connected lip 27 that is retained within the header 12 after a bag has been removed.

In use, a polymer bag, such as the bag 23, is removed when one tears the bag along the line of perforations 28 to separate the bag from the stack 21. The lip 27 is retained within the header 12. As best shown in FIG. 4, the line of perforations 28 is located adjacent a leading edge 12*a* of the header 12 so that, as bags are removed seriatim from the stack 21, residual lips 27 form a relatively smooth non-interfering edge for subsequent bag removal. Thus, in a novel manner, not only do the lips 27 not interfere with removal of the top most bag 23, but facilitate removal by providing a relatively smooth edge along which the bag back panel 24 can be torn. It will be noted that this novel feature comprises an advance over the prior art.

In addition to the above, the lips 27 also enable easy separation of the front panel 25 from the back panel 24 thereby to afford the opening 26 into the bag interior. The opening 26 is accessible to a user while the bag 23 is still retained in the header 12 and, as a result, rapid and efficient front loading of newspapers and flyers, for example, can be accomplished while the bag is still in the stack. In this manner, an efficient and effective bag packing operation can be accomplished without any need for an additional step of bag removal and positioning, prior to insertion of material into the bag.

Considering now the header 12 in greater detail, with reference especially to FIGS. 3 and 5, the header is of elongated rectangular configuration, having a curved tab 41 extending from a body portion 31. The tab 41 includes an opening 33 formed therein. Opposite the tab 41 is a complementary cutout portion 38 that is cut from the header body portion 31. The cutout portion 38 includes a generally contoured, curved shape. It will be noted, with reference to FIG. 4, that the line of perforations 28 is disposed adjacent to, and parallel with, the lateral portions of the leading edge 12*a* while it also follows the contours of the cut out portion 38. The line of perforations 28 may be spaced from the leading edge 12*a* by a distance of about ⅛ inch to a distance of about ½ inch with a preferred distance being about ¼ inch.

The contoured line of perforations 28 substantially smoothens the bag tearing process. In addition, the contoured line of perforations 28 provides for the formation of a generally curved flap 39 on the bag back panel 24. The provision of the flap 39 makes it substantially easier to open a dispensed bag, as contrasted with conventional bags, and it facilitates bag loading. As a result, bag packing operations can be speeded up.

In addition to the opening 33, the header 12 includes openings 37*a*–37*d*, which provide flexibility in mounting the dispenser 10 on a variety of surfaces. Thus, the dispenser 10 can be readily mounted on a wall mounted hook or peg (not shown) or on a table or counter edge as shown in FIG. 5. Here, the dispenser 10 is bent over a table or counter edge M while pegs P, inserted through the openings 37*b* and 37*c*, support the dispenser 10.

Figure 6:
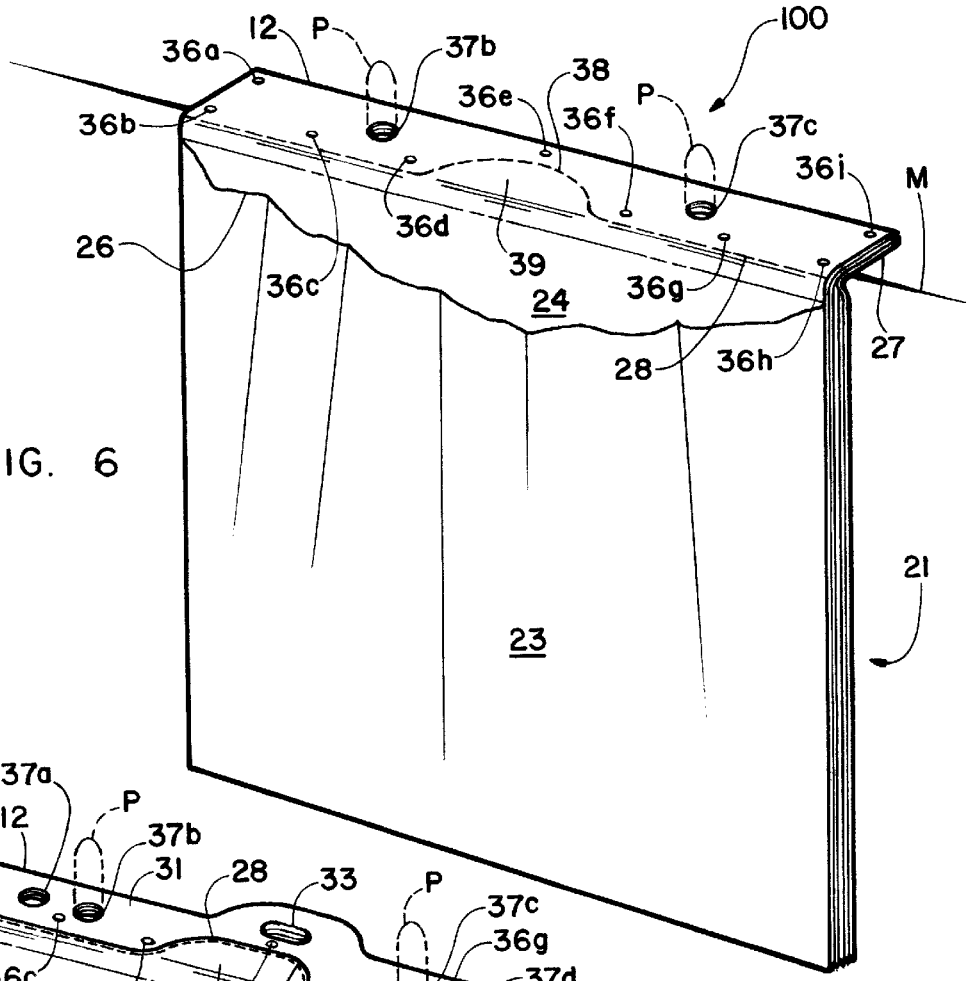
FIG. 6 is a perspective view of another embodiment of the polymer bag dispenser constructed according to the present invention.

With reference now to FIG. 6, there is shown a bag dispenser 100 which is another embodiment of the present invention. The elements of this dispenser are identical to counterparts in the dispenser 10 and, as a result, bear identical reference numerals. Unlike the dispenser 10, however, the dispenser 100 contains an ordered stack of polymer bags without a header. As shown in the figure, the dispenser is supported by pegs P, inserted through openings 37*b* and 37*c* formed in stacked lips 27. The dispenser 100 includes the novel advantages set forth above with respect to the dispenser 10.

Figure 7:
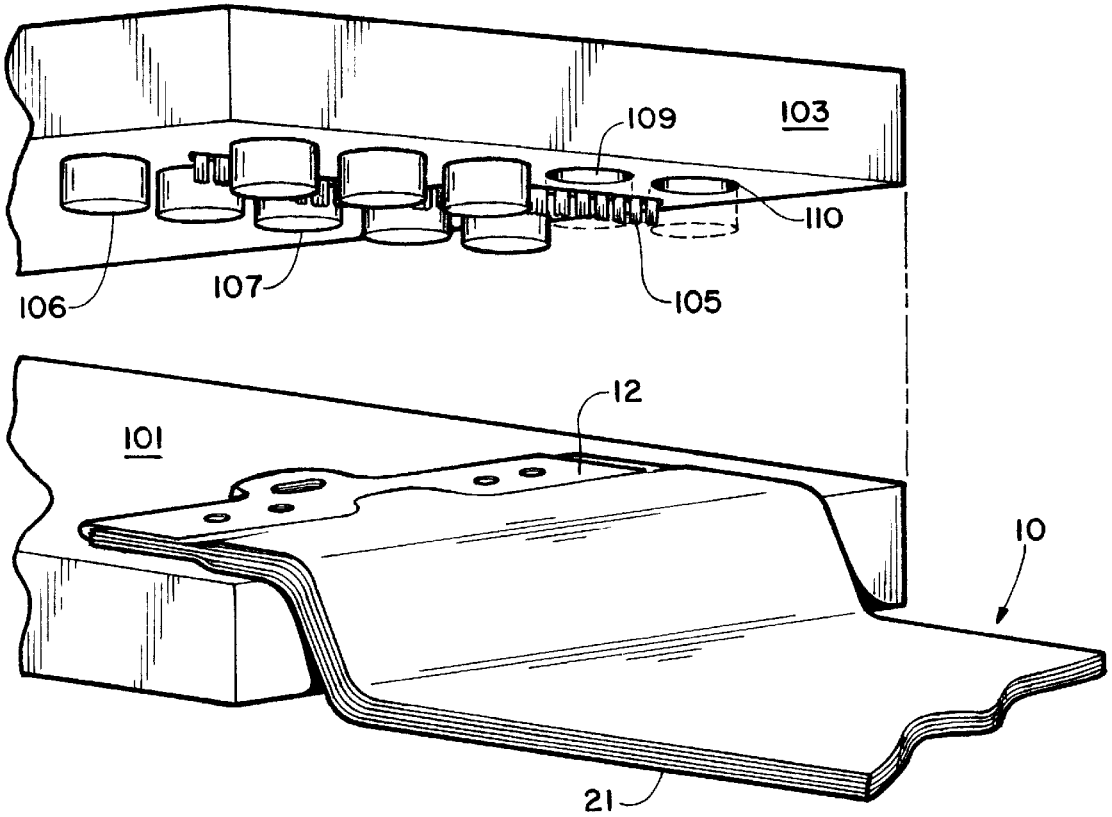
FIG. 7 a partly diagrammatic view showing a technique for assembling the polymer bag shown in FIG. 3.

The significance of the location, contour and method of forming the line of perforations 28 has been discussed above. With reference now to FIG. 7, there is depicted a technique for forming the line of perforations 28 in an ordered stack 21 of polymer bags. It will be noted that a dispenser 10 is disposed so that the header 12 is suitably placed on a die 101. Means for aligning the header, such as datum points, and means for holding the dispenser 10 in place, are not shown and it will be appreciated that conventional methods are suitable. In order to form the line of perforations 28, a punch 103 containing a cutter 105, is forced against the die 101. Spring driven strippers 106, 107, 109 and 110 serve to hold the dispenser against the die 110 as the cutter 105 is retracted. (The strippers 109 and 110 are shown partially in phantom so that the cutter 105 can be seen clearly.) One skilled in the art of polymer bag dispensers will recognize that the technique for forming the line of perforations 28 in an ordered stack, rather than in individual bags, affords a substantially improved bag dispenser.

Each bag of the plurality of bags is generally rectangular in shape having a front and a back panel. In a preferred embodiment, the front panel is shorter than the back panel and a line of perforation, substantially parallel to the tops of the panels, is formed in the back panel at a height above the top of the front panel. The front and back panels are secured along their side edges and along their bottom edge. The top edges of the front and back panels are left separate from one another and together they define an opening into the bag interior.

From the foregoing it will be appreciated that the polymer bag dispenser provided by the invention provides an efficient technique for stacking such bags and for enabling a front free configuration for the topmost bag. The provision of a line of perforation at a separated distance from the header leading edge permits convenient separation of the bag from the stack. In addition, this factor enables a clean and uniform lip edge to be formed as bags are progressively removed from the stack. Thus, unlike conventional stacked bag systems, the lips aid in bag separation, rather than function as an impediment to separation.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A bag dispenser, comprising:

a header for receiving a plurality of stacked bags, said header having a leading edge;

means for retaining a stack of bags within said header;

a plurality of bags, each one of said plurality of bags having a back panel and a front panel wherein said back panel is longer than said front panel, said back panel having a lip integrally connected thereto; and a line of perforations formed in said back panel wherein said line of perforations is located outside said header and separated from said header leading edge.

2. The bag dispenser according to claim 1, wherein the material of said plurality of bags is selected from the class consisting of polyethylene and polyprophylene.

3. The bag dispenser according to claim 1, wherein the lip of each one of said back panels is retained by said header when a bag is separated therefrom along said line of perforations.

4. The bag dispenser according to claim 1, wherein said header has a cutout portion therein formed, for facilitating separation of a bag therefrom.

5. The bag dispenser according to claim 4, wherein said header is elongated and said cutout portion is formed at a central location in said header.

6. The bag dispenser according to claim 4, wherein said cutout portion is curved in shape.

7. The bag dispenser according to claim 1, wherein each one of said back panels includes an integrally formed curved flap.

8. The bag dispenser according to claim 1, wherein said line of perforations is disposed at a distance of between about ⅛th inch and about ½ inch away from said header leading edge when a bag is retained within said header.

9. The bag dispenser according to claim 1, wherein said line of perforations is disposed at a distance of about ¼ inch away from said header leading edge when a bag is retained within said header.

10. A bag dispenser, comprising:

a header for receiving a plurality of stacked bags, said header having a contoured leading edge;

means for retaining a stack of bags within said header;

a plurality of bags, each one of said plurality of bags having a back panel and a lip, wherein said lip is retained within said header, and a front panel, said front panel having a free edge, said free edge being disposed in spaced relationship with said header leading edge; and a line of perforations formed in said back panel wherein said line of perforations follows the contours of said header leading edge, said line of perforations being located outside said header and separated from said header leading edge.

11. The bag dispenser according to claim 10, wherein the material of said plurality of bags is selected from the class consisting of polyethylene and polyprophylene.

12. The bag dispenser according to claim 10, wherein each one of said back panel lips is retained by said header when a bag is separated therefrom along said line of perforations.

13. The bag dispenser according to claim 10, wherein said header has a cutout portion therein formed, for facilitating separation of a bag therefrom.

14. The bag dispenser according to claim 13, wherein said header is elongated and said cutout portion is formed at a central location in said header.

15. The bag dispenser according to claim 13, wherein said cutout portion is curved in shape.

16. The bag dispenser according to claim 10, wherein each one of said back panels includes an integrally formed curved flap.

17. The bag dispenser according to claim 10, wherein said line of perforations is disposed at a distance of between about ⅛th inch and about ½ inch away from said header leading edge when a bag is retained within said header.

18. The bag dispenser according to claim 10, wherein said line of perforations is disposed at a distance of about ¼ inch away from said header leading edge when a bag is retained within said header.

19. A method of assembling a stacked polymer bag dispenser, comprising the steps of:

providing a plurality of fungible polymer bags, each one of said bags including a front panel and a back panel wherein said back panel is longer than said front panel;

assembling said bags in an ordered stack;

providing a header for receiving said plurality of stacked bags, said header having a leading edge;

installing the stacked bags within said header;

sealing together portions of said bags and said header; and forming a line of perforations in the back panel of each one of said stacked bags wherein a lip is formed in each one of said back panels and said line of perforations formed in said back panel is located outside said header and separated from said header leading edge.

20. The method according to claim 19, wherein said installing step includes providing openings in said header for enabling said bag dispenser to be suspended from a support.

* * * * *